US007746243B2

(12) United States Patent
Chen et al.

(10) Patent No.: US 7,746,243 B2
(45) Date of Patent: Jun. 29, 2010

(54) PUMP FAILURE ALARM DEVICE

(75) Inventors: Ying Chen, Shenzhen (CN); Jin-Liang Xiong, Shenzhen (CN)

(73) Assignees: Hong Fu Jin Precision Industry ( ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 285 days.

(21) Appl. No.: 11/874,917

(22) Filed: Oct. 19, 2007

(65) Prior Publication Data

US 2008/0157989 A1 Jul. 3, 2008

(30) Foreign Application Priority Data

Dec. 29, 2006 (CN) ..... 2006 1 0201463

(51) Int. Cl.
*G08B 21/00* (2006.01)

(52) U.S. Cl. ..... 340/660; 340/661

(58) Field of Classification Search ..... 340/500, 340/540, 657, 660–663; 327/419, 432, 478, 327/482, 484, 489–492
See application file for complete search history.

(56) References Cited

U.S. PATENT DOCUMENTS 4,228,427 A * 10/1980 Niedermeyer ..... 340/623
5,448,175 A * 9/1995 Nishibe et al. ..... 324/546
5,534,854 A * 7/1996 Bradbury et al. ..... 340/648
5,677,672 A 10/1997 Vogt et al.
5,745,041 A * 4/1998 Moss ..... 340/635
6,254,767 B1 * 7/2001 Shin et al. ..... 210/85

* cited by examiner

*Primary Examiner*—Brian A Zimmerman
*Assistant Examiner*—James Yang
(74) *Attorney, Agent, or Firm*—Frank R. Niranjan

(57) ABSTRACT

A pump failure alarm device includes two digital-analog converting circuits (100, 110), a voltage sampling circuit (120), a controlling circuit (130), an I/O controller (U11), and an alarm circuit (140). The digital-analog converting circuits receive digital pulse signals from two pumps (200, 210), and respectively output a DC voltage signal at an output terminal when the pumps run normally. The voltage sampling circuit with two input terminals respectively coupled to the output terminals of the two digital-analog converting circuits, and outputs a first voltage signal when the two pumps run normally and outputs a second voltage signal when either or both of the pumps stop running. The controlling circuit receives the voltage signals from the voltage sampling circuit, and outputs a first control signal when it receives the first voltage signal and outputs a second control signal when it receives the second voltage signal. The I/O controller receives the control signals from the controlling circuit, and outputs an alarm signal when it receives the second control signal. The alarm circuit receives the alarm signal from the I/O controller, and activates an alarm.

7 Claims, 1 Drawing Sheet

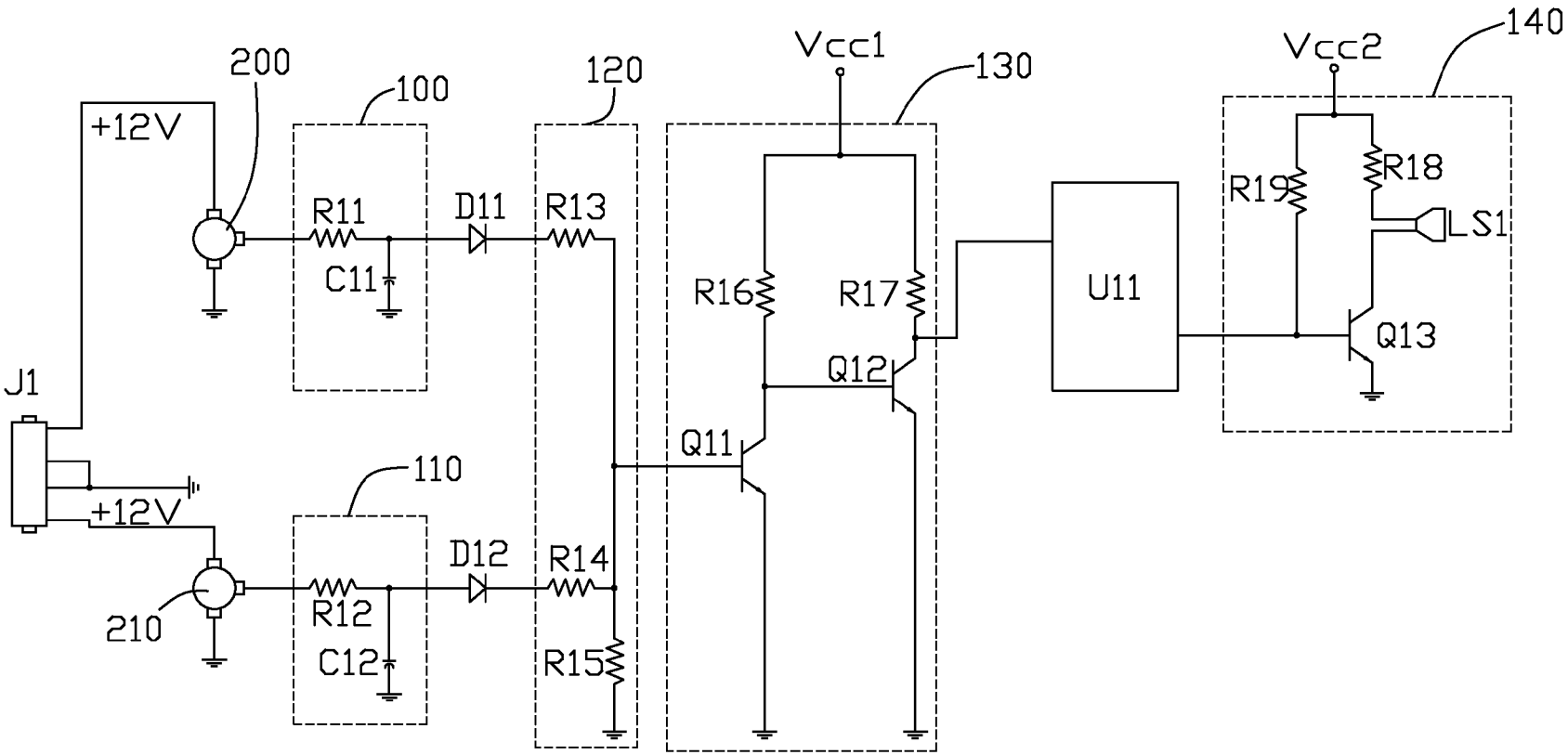
140
Vcc2
R18
LS1
Q13
R19
U11
130
Vcc1
R17
Q12
R16
Q11
120
R13
R14
R15
D11
D12
100
110
R11
C11
R12
C12
200
210
+12V
+12V
J1

PUMP FAILURE ALARM DEVICE

CROSS-REFERENCES TO RELATED APPLICATION

This application is related to a co-pending application entitled with "FAN FAILURE ALARM DEVICE", filed on Sep. 20, 2007 with application Ser. No. 11/858,122, and assigned to the same assignee of the present invention.

BACKGROUND

1. Field of the Invention

The present invention relates to alarm devices, and particularly to an alarm device for indicating a failure of pumps in a computer system.

2. Description of Related Art

Developments in today's highly information-intensive society have led to remarkable improvements in performances of electronic devices. During operation of many contemporary electronic devices such as central processing units (CPUs), large amounts of heat are produced. Typically, two pumps are used to facilitate removal of heat. One pump is used to pump water, the other pump is used to drain water. The pumps must be running stably, so as to prevent the device from becoming unstable or being damaged. If either or both of the pumps run unstably or even cease running, heat generated from the CPU will not be dissipated on time and will ruin the CPU.

What is needed, therefore, is to provide an alarm device for when pump(s) stop running in a computer system.

SUMMARY

An exemplary alarm device for pumps includes two digital-analog converting circuits, a voltage sampling circuit, a controlling circuit, an I/O controller, and an alarm circuit. The digital-analog converting circuits receive digital pulse signals from two pumps, and respectively output a DC voltage signal at an output terminal when the pumps run normally. The voltage sampling circuit with two input terminals respectively coupled to the output terminals of the two digital-analog converting circuits, outputs a first voltage signal when the two pumps run normally and outputs a second voltage signal when either or both of the pumps stop running. The controlling circuit receives the voltage signals from the voltage sampling circuit, and outputs a first control signal when it receives the first voltage signal and outputs a second control signal when it receives the second voltage signal. The I/O controller receives the control signals from the controlling circuit, and outputs an alarm signal when it receives the second control signal. The alarm circuit receives the alarm signal from the I/O controller, and activates an alarm.

Other objects, advantages and novel features of the present invention will become more apparent from the following detailed description of preferred embodiments when taken in conjunction with the accompanying drawings, in which:

BRIEF DESCRIPTION OF THE DRAWINGS

The drawing is a circuit diagram of an embodiment of an alarm device for pumps in accordance with the present invention.

DETAILED DESCRIPTION

Referring to the drawing, an alarm device for pumps in accordance with an embodiment of the present invention includes two digital-analog converting circuits 100, 110, two diodes D11, D12, a voltage sampling circuit 120, a controlling circuit 130, an input-output (I/O) controller U11, and an alarm circuit 140.

In this embodiment, the digital-analog converting circuit 100 includes a resistor R11 and a capacitor C11. One terminal of the resistor R11 is coupled to a pump 200, the other terminal of the resistor R11 is coupled to one terminal of the capacitor C11, the other terminal of the capacitor C11 is coupled to ground. The digital-analog converting circuit 110 includes a resistor R12 and a capacitor C12. One terminal of the resistor R12 is coupled to a pump 210, the other terminal of the resistor R12 is coupled to one terminal of the capacitor C12, the other terminal of the capacitor C12 is coupled to ground. A node between the resistor R11 and the capacitor C11 is coupled to the anode of the diode D11. A node between the resistor R12 and the capacitor C12 is coupled to the anode of the diode D12.

The voltage sampling circuit 120 includes three resistors R13, R14, R15. One terminal of each of the resistors R13, R14 is respectively coupled to the cathodes of the diodes D11, D12, the other terminals of the resistors R13, R14 are coupled to one terminal of the resistor R15, the other terminal of the resistor R15 is coupled to ground.

The controlling circuit 130 includes two transistors Q11, Q12, and two resistors R16, R17. The base of the transistor Q11 is coupled to a node between the resistors R13 and R14. The collector of the transistor Q11 is coupled to the base of the transistor Q12, and coupled to a power supply Vcc1 via the resistor R16. The collector of the transistor Q12 is coupled to the power supply Vcc1 via the resistor R17, and coupled to an input terminal of the I/O controller U11. The emitters of the transistors Q11, Q12 are coupled to ground.

The alarm circuit 140 includes a transistor Q13, a buzzer LS1, and two resistors R18, R19. The base of the transistor Q13 is coupled to an output terminal of the I/O controller U11, and coupled to a power supply Vcc2 via the resistor R19. The collector of the transistor Q13 is coupled to one terminal of the buzzer LS1, the other terminal of the buzzer LS1 is coupled to the power supply Vcc2 via the resistor R18. The emitter of the transistor Q13 is coupled to ground.

The pumps 200, 210 respectively receive 12V direct current voltage from a power supply J1 and are driven by the power supply J1. When the pumps 200, 210 run normally, the pumps 200, 210 respectively output a digital pulse signal. The digital-analog converting circuits 100, 110 respectively receive the digital pulse signals from the pumps 200, 210, and output a first direct current (DC) voltage signal and a second DC voltage signal. The diodes D11, D12 are on, the first and second DC voltage signals are output to the voltage sampling circuit 120, and are superimposed at the output terminal of the voltage sampling circuit 120. Voltage at the base of the transistor Q11 is at a high level, the transistor Q11 turns on. Voltage at the collector of the transistor Q11 is at a low level, the transistor Q12 is off. The controlling circuit 130 outputs a high level voltage to the I/O controller U11, the I/O controller U11 receives the high level voltage, and outputs a low level voltage to the alarm circuit 140. The transistor Q13 is off, and the buzzer LS1 is not activated.

If either or both of the pumps 200, 210 stop running then the failed pump or pumps 200, 210 will not output a digital pulse signal. In that case, one or both of the diodes D11, D12 turn off, voltage at the base of the first transistor Q11 goes low, the first transistor Q11 turns off, the second transistor Q12 turns on, the controlling circuit 130 outputs a low level voltage to the I/O controller U11, the I/O controller U11 outputs a high level voltage to the alarm circuit 140, the transistor Q13 turns on, and the buzzer LS1 is activated to sound an alarm indicating that one or both of the pumps 200, 210 have failed.

In this embodiment, the diodes D11, D12 are respectively used to protect the pumps 200, 210. When the pump 200 stops running but the pump 210 runs normally, the second DC voltage signal output from the digital-analog converting circuit 110 will not go though the diode D11, and protects the pump 200 from being ruined. When the pump 210 stops running but the pump 200 runs normally, the first DC voltage signal output from the digital-analog converting circuit 100 will not go though the diode D12, and protects the pump 210 from being ruined.

The foregoing description of the exemplary embodiment of the invention has been presented only for the purposes of illustration and description and is not intended to be exhaustive or to limit the invention to the precise forms disclosed. Many modifications and variations are possible in light of the above teaching. The embodiment was chosen and described in order to explain the principles of the invention and its practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiment described therein.

What is claimed is:

1. A pump failure alarm device, comprising:

two digital-analog converting circuits configured for receiving digital pulse signals respectively from two pumps, and respectively outputting a direct current (DC) voltage signal at an output terminal when the pumps run normally, wherein each digital-analog converting circuit comprises a resistor and a capacitor, one terminal of each of the resistors is coupled to a corresponding pump, the other terminal of each of the resistors acting as the output terminal of each digital-analog converting circuits coupled to one terminal of a corresponding capacitor, another terminal of each of the capacitors is coupled to ground;

a voltage sampling circuit with two input terminals respectively coupled to the output terminals of the two digital-analog converting circuits, and outputting a first voltage signal when the two pumps run normally and outputting a second voltage signal when either or both of the pumps stop running;

a controlling circuit configured for receiving the voltage signals from the voltage sampling circuit, and outputting a first control signal when it receives the first voltage signal and outputting a second control signal when it receives the second voltage signal;

an input-output (I/O) controller with an input terminal receiving the control signals from the controlling circuit, and outputting an alarm signal at an output terminal when it receives the second control signal; and an alarm circuit configured for receiving the alarm signal from the I/O controller, and activating an alarm.

2. The pump failure alarm device as claimed in claim 1, further comprising two diodes with anodes respectively coupled to the output terminals of the two digital-analog converting circuits, cathodes of the diodes respectively coupled to the two input terminals of the voltage sampling circuit.

3. The pump failure alarm device as claimed in claim 1, wherein the voltage sampling circuit comprises a first resistor, a second resistor, and a third resistor, one terminal of the first and second resistors respectively acting as the two input terminals of the voltage sampling circuit, the other terminals of the first and second resistors are both coupled to one terminal of the third resistor, and the other terminal of the third resistor is coupled to ground.

4. The pump failure alarm device as claimed in claim 3, wherein the controlling circuit comprises a first transistor, and a second transistor, the base of the first transistor is coupled to a node between the first and second resistors, the collector of the first transistor is coupled to the base of the second transistor, the collector of the second transistor is coupled to the input terminal of the I/O controller, the collectors of the first and second transistors are coupled to a power supply respectively via a fourth resistor and a fifth resistor, and the emitters of the first and second transistors are coupled to ground.

5. The pump failure alarm device as claimed in claim 1, wherein the alarm circuit comprises a third transistor, a buzzer, a sixth resistor, and a seventh resistor, the base of the third transistor is coupled to the output terminal of the I/O controller, and also coupled to another power supply via the sixth resistor, the emitter of the third transistor is coupled to ground, the collector of the third transistor is coupled to one terminal of the buzzer, the other terminal of the buzzer is coupled to the power supply via the seventh resistor.

6. A pump failure alarm device, comprising:

two digital-analog converting circuits configured for receiving digital pulse signals respectively from two pumps, and respectively outputting a direct current (DC) voltage signal at an output terminal when the pumps run normally;

a voltage sampling circuit with two input terminals respectively coupled to the output terminals of the two digital-analog converting circuits, and outputting a first voltage signal when the two pumps run normally and outputting a second voltage signal when either or both of the pumps stop running, wherein the voltage sampling circuit comprises a first resistor, a second resistor, and a third resistor, one terminal of the first and second resistors respectively acting as the two input terminals of the voltage sampling circuit, the other terminals of the first and second resistors are both coupled to one terminal of the third resistor, and the other terminal of the third resistor is coupled to ground;

a controlling circuit configured for receiving the voltage signals from the voltage sampling circuit, and outputting a first control signal when it receives the first voltage signal and outputting a second control signal when it receives the second voltage signal;

an input-output (I/O) controller with an input terminal receiving the control signals from the controlling circuit, and outputting an alarm signal at an output terminal when it receives the second control signal; and an alarm circuit configured for receiving the alarm signal from the I/O controller, and activating an alarm.

7. A pump failure alarm device, comprising:

two digital-analog converting circuits configured for receiving digital pulse signals respectively from two pumps, and respectively outputting a direct current (DC) voltage signal at an output terminal when the pumps run normally;

a voltage sampling circuit with two input terminals respectively coupled to the output terminals of the two digital-analog converting circuits, and outputting a first voltage signal when the two pumps run normally and outputting a second voltage signal when either or both of the pumps stop running;

a controlling circuit configured for receiving the voltage signals from the voltage sampling circuit, and outputting a first control signal when it receives the first voltage signal and outputting a second control signal when it receives the second voltage signal;

an input-output (I/O) controller with an input terminal receiving the control signals from the controlling circuit, and outputting an alarm signal at an output terminal when it receives the second control signal; and an alarm circuit configured for receiving the alarm signal from the I/O controller, and activating an alarm, wherein the alarm circuit comprises a transistor, a buzzer, a first resistor, and a second resistor, the base of the transistor is coupled to the output terminal of the I/O controller, and also coupled to a power supply via the first resistor, the emitter of the transistor is coupled to ground, the collector of the transistor is coupled to one terminal of the buzzer, the other terminal of the buzzer is coupled to the power supply via the second resistor.

* * * * *